United States Patent [19]

Takabe

[11] Patent Number: 4,503,941

[45] Date of Patent: Mar. 12, 1985

[54] SUPERVISORY APPARATUS FOR ELEVATORS

[75] Inventor: Katsunori Takabe, Inazawa, Japan

[73] Assignee: Mitsubishi Denki Kabushiki Kaisha, Japan

[21] Appl. No.: 578,264

[22] Filed: Feb. 8, 1984

[30] Foreign Application Priority Data

Feb. 15, 1983 [JP] Japan ..... 58-23019

[51] Int. Cl.[3] ..... B66B 1/18

[52] U.S. Cl. ..... 187/29 R

[58] Field of Search ..... 187/29

[56] References Cited

U.S. PATENT DOCUMENTS

| | | | |
|---|---|---|---|
| 3,536,164 | 10/1970 | Chenhall | 187/29 |
| 3,572,470 | 3/1971 | Hirsch et al. | 187/29 |
| 3,593,825 | 7/1971 | Gieseler | 187/29 |
| 3,831,715 | 8/1974 | Matsuzawa et al. | 187/29 |
| 3,895,692 | 7/1975 | Yeasting | 187/29 |
| 4,357,997 | 11/1982 | Hussou et al. | 187/29 |
| 4,401,190 | 8/1983 | Bittar | 187/29 |
| 4,411,338 | 10/1983 | Kuzunuki et al. | 187/29 |

*Primary Examiner*—William M. Shoop
*Assistant Examiner*—W. E. Duncanson, Jr.
*Attorney, Agent, or Firm*—Leydig, Voit, Osann, Mayer and Holt, Ltd.

[57] ABSTRACT

A supervisory apparatus for elevators wherein cages are respectively caused to disperse and wait at predetermined floors during an inactive elevator operation during which a demand for the cages has decreased; the demand magnitudes of the cages in each of a predetermined number of time zones into which one day is divided, future demand magnitudes are estimated for each time zone on the basis of the measured values, and a suitable number of floors are allotted to each cage on the basis of the estimated demand magnitudes so that the respective cages may take charges of equal demand magnitudes during the inactive elevator operation. Further, the waiting floor of each cage is determined at that floor of the allotted floors at which an expected value of a period of time required for responding to a next occurring hall call becomes the smallest.

10 Claims, 11 Drawing Figures

SUPERVISORY APPARATUS FOR ELEVATORS

BACKGROUND OF THE INVENTION

This invention relates to improvements in an apparatus for supervising elevators.

In the group supervision of a plurality of cages, it is common practice that, when no hall call has occurred for a fixed period of time while the elevator operation is inactive, the cages are caused to run to commanded floors and to dispersedly wait thereat, so as to quicken the response to a hall call to occur subsequently. This is disclosed in, for example, the official gazette of Japanese Patent Application Laying-open No. 48–91742.

With the prior-art group-supervisory elevator system, however, the floors at which the cages are caused to dispersedly wait are previously set, and hence, the cages wait at the specified floors at all times. In consequence, the situations arise where only those floors are well served and a situation where the cages wait at floors unsuited to the actual elevator traffic arises due to the traffic fluctuating as a function of time zones.

SUMMARY OF THE INVENTION

This invention is intended to improve the above drawbacks, and has for its object to provide a group-supervisory apparatus for elevators in which dispersed waiting floors are determined by the estimated values of the demand magnitudes of cages so that the respective cages may take charges of equal demand magnitudes in each time zone, whereby a hall call to subsequently occur can be served most efficiently, and all halls can be equally served.

DESCRIPTION OF THE PREFERRED EMBODIMENTS

Now, an embodiment of this invention will be described with reference to FIGS. 1 to 11.

Figure 1:
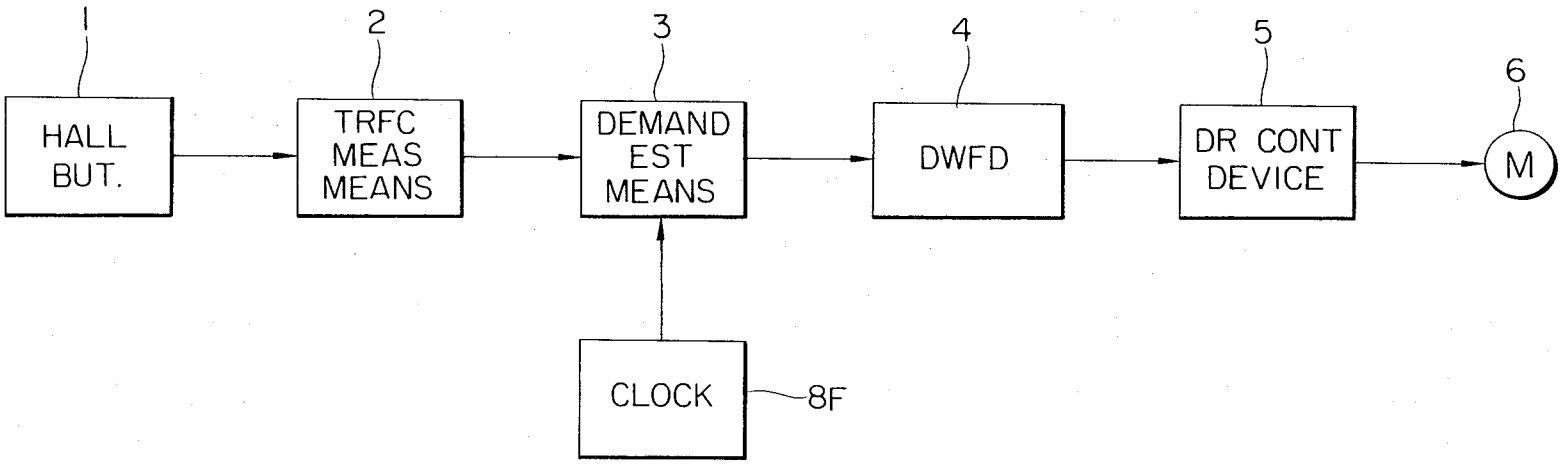
FIG. 1 is a general arrangement diagram illustrative of an embodiment of a supervisory apparatus for elevators according to this invention.
Figure 2:
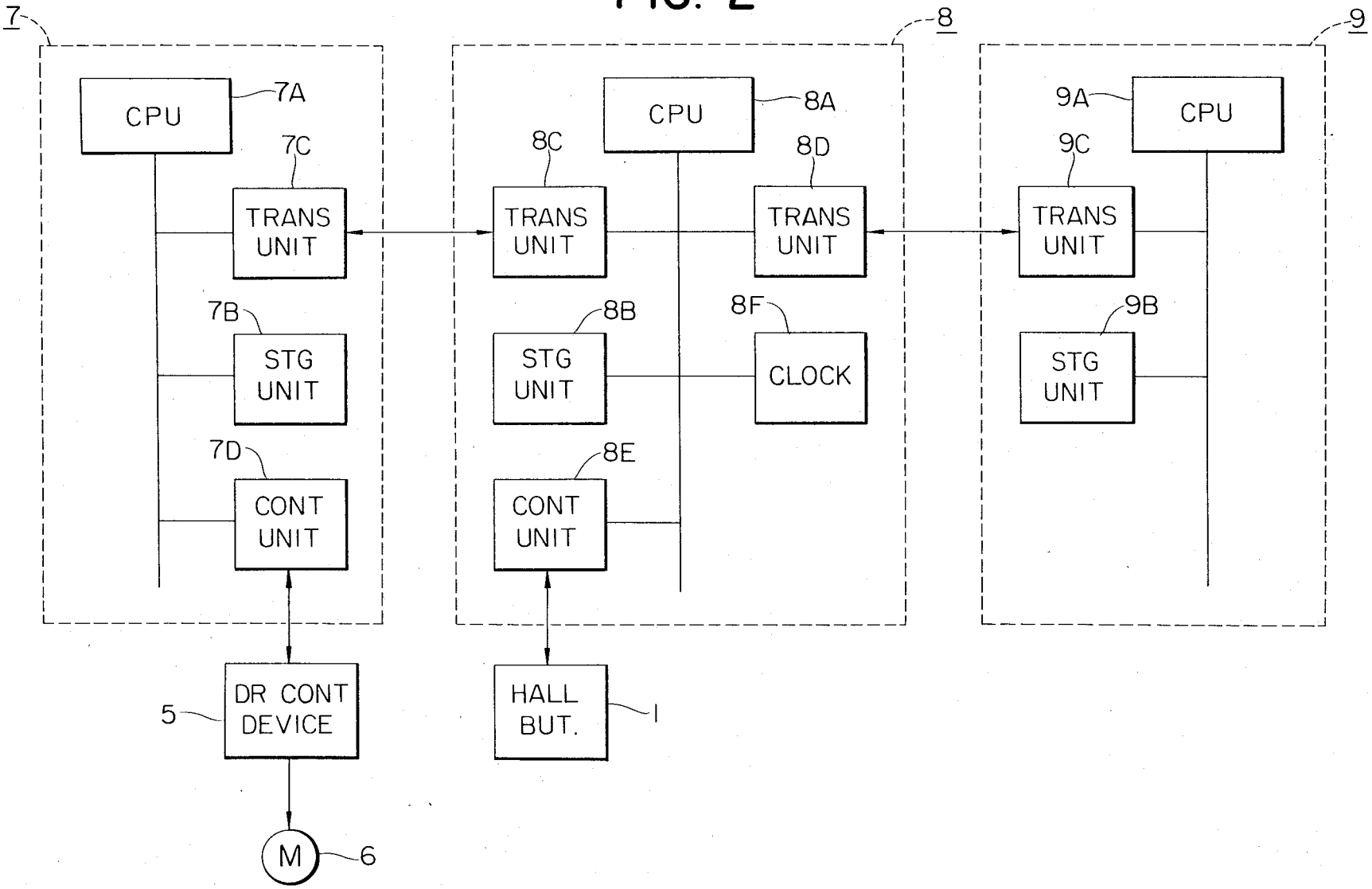
FIG. 2 is a block circuit diagram of the embodiment.

In FIGS. 1 and 2, numeral 1 designates a hall button, numeral 2 traffic volume measurement means to measure the traffic volume of an elevator from the output of the hall button 1, numeral 3 demand magnitude estimation means to take the statistics of the traffic volumes of respective time zones for respective floors so as to estimate a future demand magnitude, numeral 4 dispersed waiting floor determination means (DWFD) to determine the dispersed waiting floor of a cage to a floor at which the estimated values of the demand magnitudes equalize, and numeral 5 a drive and control device while drives and controls a hoist motor 6 so as to operate the cage to the determined waiting floor.

The traffic volume measurement means 2, the demand magnitude estimation means 3 and the dispersed waiting floor determination means 4 are realized by a plurality of microcomputers to be described below.

Numeral 7 designates a cage control device which is constructed of a microcomputer (the device corresponding to one cage only is shown), and which is disclosed in the official gazette of Japanese Patent Application Laying-open No. 51–53354 by way of example. It comprises a central processing unit (hereinbelow, called "CPU") 7A, a storage unit 7B which consists of a read only memory (hereinbelow, called "ROM") storing program and data of fixed values and a random access memory (hereinbelow, called "RAM") for temporarily storing data of calculated results etc., a transmission unit 7C which sends and receives data, and a conversion unit 7D which is connected to the drive and control device 5 and which converts the signal levels of an input and an output. A group supervisory device 8 is also constructed of a microcomputer, and it similarly comprises a CPU 8A, a storage unit 8B, transmission units 8C and 8D, a conversion unit 8E and a clock 8F. An estimation device 9 is also constructed of a microcomputer, and it similarly comprises a CPU 9A, a storage unit 9B and a transmission unit 9C.

Next, the operation of this embodiment will be described.

First, the outline of the embodiment will be explained.

The group supervisory device 8 controls an operation mode such as the allotment of cages on the basis of cage information sent from the cage control device 7 and hall information sent from respective halls. Further, some of these information are sent to and stored in the estimation device 9 as an elevator traffic volume. The estimation device 9 takes the statistics of the elevator traffic volume of a certain time zone for each floor, and estimates the occurrence of the traffic volume of a particular day in accordance with the statistic result of the traffic volume of the preceding day. As the elevator traffic volumes required for determining the dispersed waiting floor, there are considered the number of occurrence of hall calls, the load of passengers having gotten on the cage (the number of persons), the number of waiting persons detected by a hall-waiter-number detector which employs an industrial television camera or the like, etc. Here, the number of occurrence of hall calls will be taken as an example.

The estimated values of the numbers of occurrence of halls calls at the respective floors in the certain time zone are derived from the estimation device 9, to find the summation of the numbers of occurrence of the hall calls at all the floors. The summation is divided by the number of cages installed or the number of cages for the dispersed waiting, to calculate the number of occurrence of allotted hall calls per cage.

$$X \leftarrow \left( \sum_{k=1}^{N} Z_k \right) / m \tag{1}$$

where

X: the number of occurrence of allotted hall calls per cage, k: floor numeral, $Z_k$: the number of occurrence of hall calls at the k-th floor, N: the number of floors (the lowermost floor is set at 1), m: the number of cages for dispersed waiting.

Next, allotment floors are determined in accordance with the following equation so that the numbers of occurrence of the allotted hall calls of the respective cages may approach the average value X:

$$0 < \sum_{k=1}^{i} Z_k \leqq X \qquad \text{Cage No. 1}$$

$$X < \sum_{k=1}^{i} Z_k \leqq 2X \qquad \text{Cage No. 2}$$

$$\vdots \qquad\qquad \vdots$$

$$(m-1)X < \sum_{k=1}^{i} Z_k \leqq Y \qquad \text{Cage No. m}$$

As indicated by Equation (2), the numbers of occurrence $Z_k$ of the hall calls of the respective floors with the first floor being the lowermost floor are cumulated, and the floors from the first floor to the floor at which the cumulated value has become X are allotted to cage No. 1. Subsequently, the numbers of occurrence of the hall calls of the next and upper floors are further cumulated, and the floors from the next floor to the floor at which the cumulated value has become 2X are allotted to cage No. 2. Lastly, cage No. m takes charge of all the floors at which the cumulated value exceeds (m−1)X. Y denotes the summation of the numbers of occurrence of the hall calls of all the floors. In this way, the respective allotted floors of the m cages are determined.

Next, among the allotted floors of each cage, which floor the cage is caused to wait at is determined. It is now assumed that the allotted floors of cage No. g be from the $N_i$-th floor to the $N_j$-th floor. At this time, the rate of occurrence of the hall calls of each of the $N_i$-th to $N_j$-th floors is calculated in accordance with the following equation:

$$K_k = Z_k / Y_g \tag{3}$$

where $K_k$: the rate of occurrence of the hall calls of the k-th floor (any of the $N_i$-th to $N_j$-th floors), $Y_g$: the summation of the number of occurrence of the hall calls of the allotted floors (the $N_i$-th to $N_j$-th floors) of cage No. g. Besides, letting $$t(k, P) \tag{4}$$

denote the period of time which is required for the cage lying at the P-th floor to serve the k-th floor, the following is calculated:

$$E_p = \sum_{k=N_i}^{N_j} K_k \times t(k, P) \tag{5}$$

Then, $E_p$ becomes the expected value of the service time for each floor in the case of causing the cage to wait at the P-th floor. Using the group supervisory device 8, cage No. g is caused to dispersedly wait at the floor at which $E_p$ becomes the minimum.

The various operations described above will be described with reference to flow charts of FIGS. 3 to 10.

Figure 3:
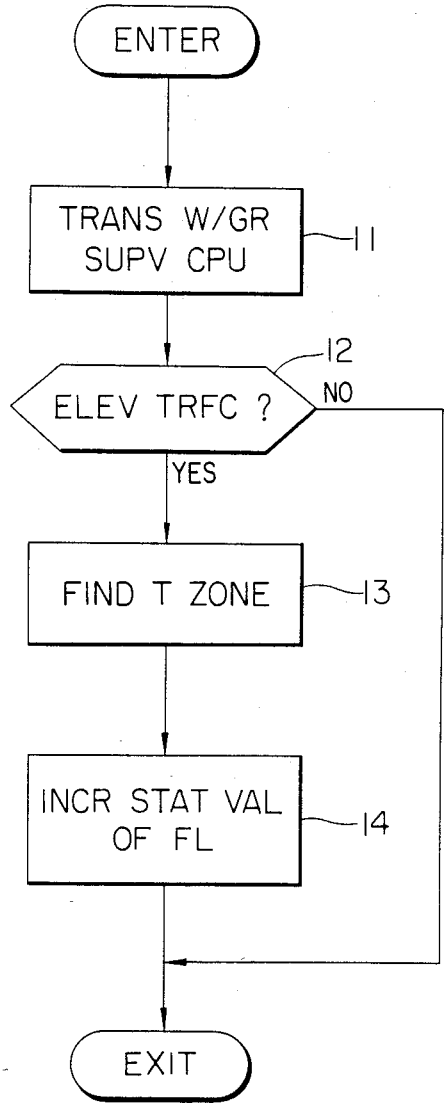
FIGS. 3 and 4 are flow charts of the operations of the embodiment based on a demand magnitude-estimating program.
Figure 4:
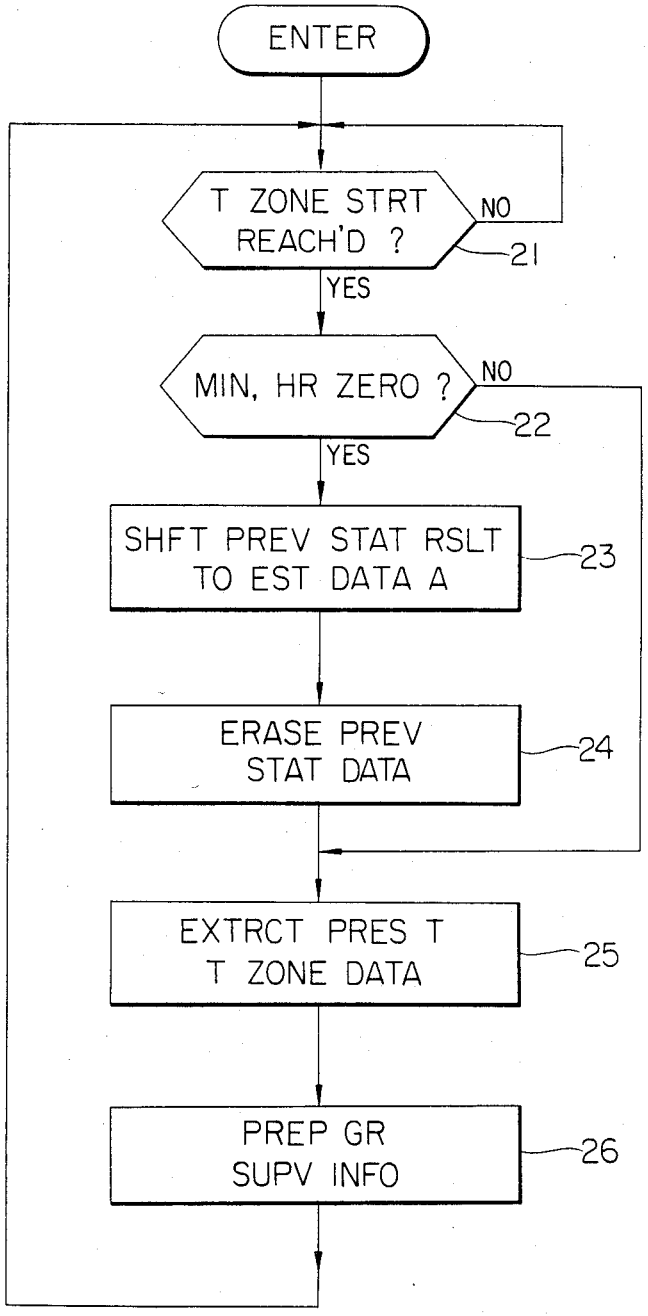

FIGS. 3 and 4 show steps for estimating the demand magnitudes of elevator traffic. They are constructed by an interrupt processing program (FIG. 3) which is controlled by interrupts arising at fixed intervals and which takes the statistics of the elevator traffic volume, and a main program (FIG. 4) which is run at the other times and which estimates the elevator demand magnitudes.

At Step 11, the estimation device 9 performs the transmission with the CPU 8A of the group supervisory device 8 to deliver group supervisory information based on a predictive traffic volume and to receive information on the elevator traffic. At Step 12, whether or not the elevator traffic has arisen is decided. The elevator traffic includes the number of persons having gotten on or off a cage, the occurrence of a hall call, the occurrence of a cage call, etc. When the elevator traffic has arisen, a time zone in which the present time is contained is found at Step 13, and the statistic value (stored in the RAM of the storage unit 9B) of the floor at which the elevator traffic has arisen is increased at Step 14. When it has been detected at Step 12 that no elevator traffic has arisen, the Steps 13 and 14 are not executed. Thus, the statistics of the magnitudes of occurrence of the elevator traffic, namely, the elevator demand magnitudes are taken for respective floors and in respective floors and in respective time zones in a predetermined number into which one day is divided.

On the other hand, whether or not the present time is the starting time of the time zone is decided at Step 21. When the starting time is not reached, the arrival thereof is awaited. When the starting time has been reached, Step 22 decides if the present time is zero o'clock zero minute. Unless the present time is zero o'clock minute, the control flow jumps to Step 25, at which the statistic data of the time zone containing the present time is extracted from the RAM 9B. At Step 26, the group supervisory information of dispersed waiting floors etc. is prepared. This Step 26 corresponds to FIGS. 5 to 10 to be referred to later. When zero o'clock zero minute has been detected at the Step 22, a statistic result at the preceding time is shifted to an area of estimation data at Step 23, and the statistic data at the preceding time is erased at Step 24. Then, the Steps 25 and 26 are executed, whereupon the control flow returns to the Step 21.

Figure 5:
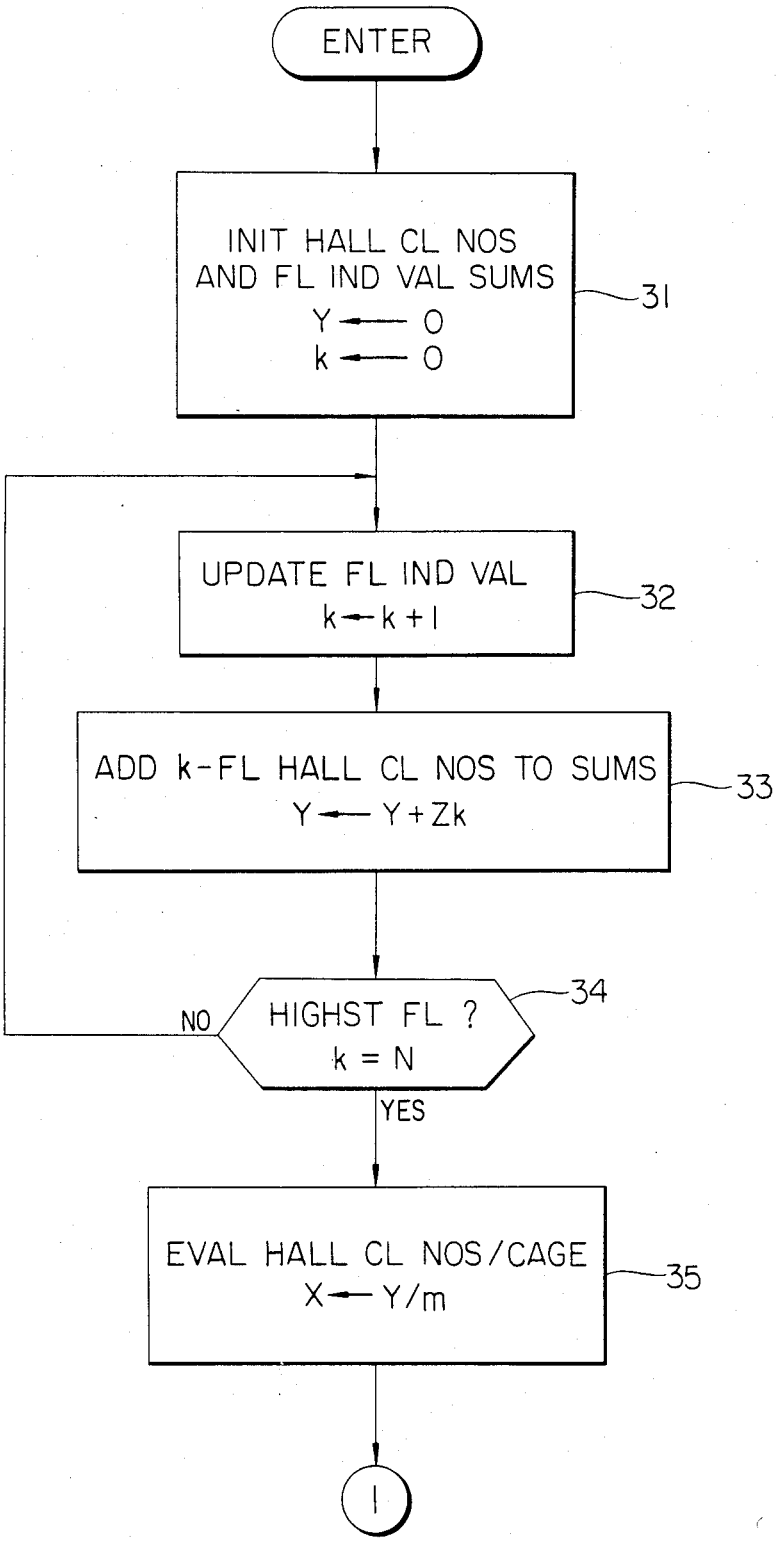
FIGS. 5 to 7 are flow charts of operations based on a cage allotment floor-determining program.
Figure 6:
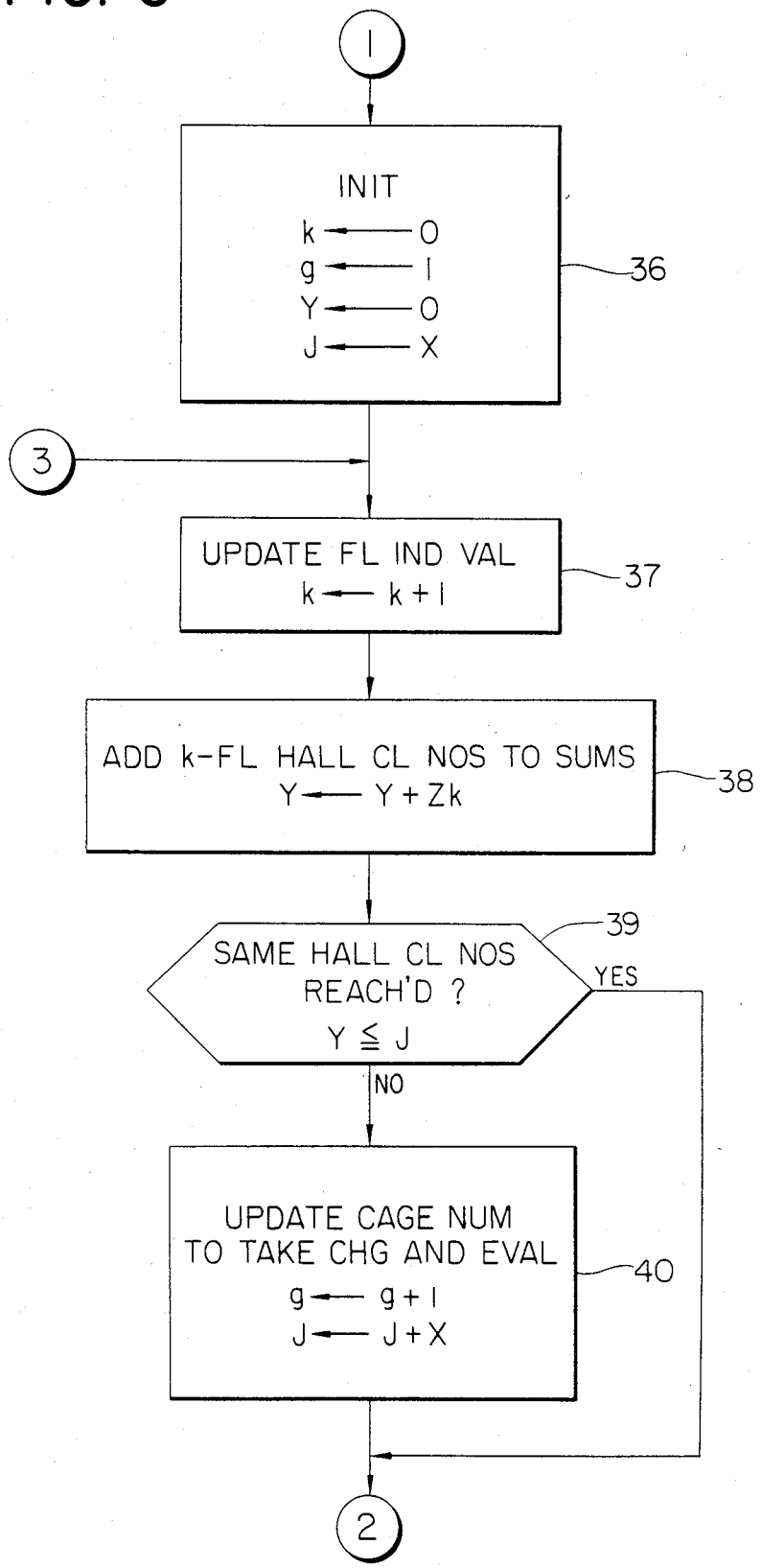
Figure 7:
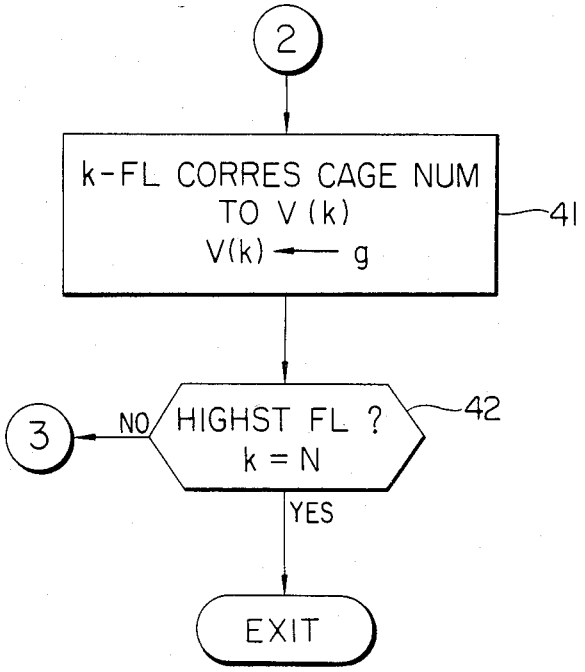

FIGS. 5 to 7 show steps which form parts of the Step 26 and which determine allotment floors so that the numbers of occurrence of hall calls to be allotted to the respective cages may become equal. At Step 31, the summation Y of the numbers of occurrence of the hall calls of all floors and the floor numeral are respectively initialized to zero. At Step 32, the floor numeral k is set at 1 (one), and at Step 33, the number of occurrence $Z_k$ of the hall calls of the k-th floor is added to the summation Y of the numbers of occurrence of the hall calls of all the floors. Whether or not the floor numeral k is equal to the floor number N is decided at Step 34, and unless the floor number N is reached, the control flow returns to the Step 32 so as to execute the Steps 32 and 33. These operations are repeated until the floor numeral k reaches the floor number N. Then, the summation Y of the numbers of occurrence of the hall calls of all the floors is divided by the number m of the dispersed waiting cages, and the resulting quotient is stored as the number of occurrence X of the allotted hall calls per cage. At Step 36, k and Y are set at zero again, and the cage No. g and the multiple J (to increase to X, 2X and 3X) are respectively set at 1 (cage No. 1) and at X. At Steps 37 and 38, the numeral k expressive of the floor is updated and the number of occurrence $Z_k$ of the hall calls of the floor is added to the summation Y, respectively. Step 39 decides whether or not the summation Y of the numbers of occurrence of the hall calls of all the floors is not greater that the multiple J. If $Y \leqq J$ holds, cage No. V(k) to take charge of the first floor is set at cage No. 1 at Step 41. Step 42 decides whether or not the floor numeral k is equal to the floor number N. Unless the floor number N is reached, the control flow returns to Step 37, and Steps 37 and 38 are executed. These are repeated until $Y \leqq J$ is held. On the other hand, if $Y > J$ holds at Step 39, cage No. g is set at No. 2, and the multiple J at 2X. At Step 41, cage No. V(k) to take charge of the k-th floor is set at No. 2. The above steps are repeated until the floor numeral k becomes equal to the floor number N. Thus, the allotment floors of the respective cages have been determined successively from the lowermost floor.

Figure 8:
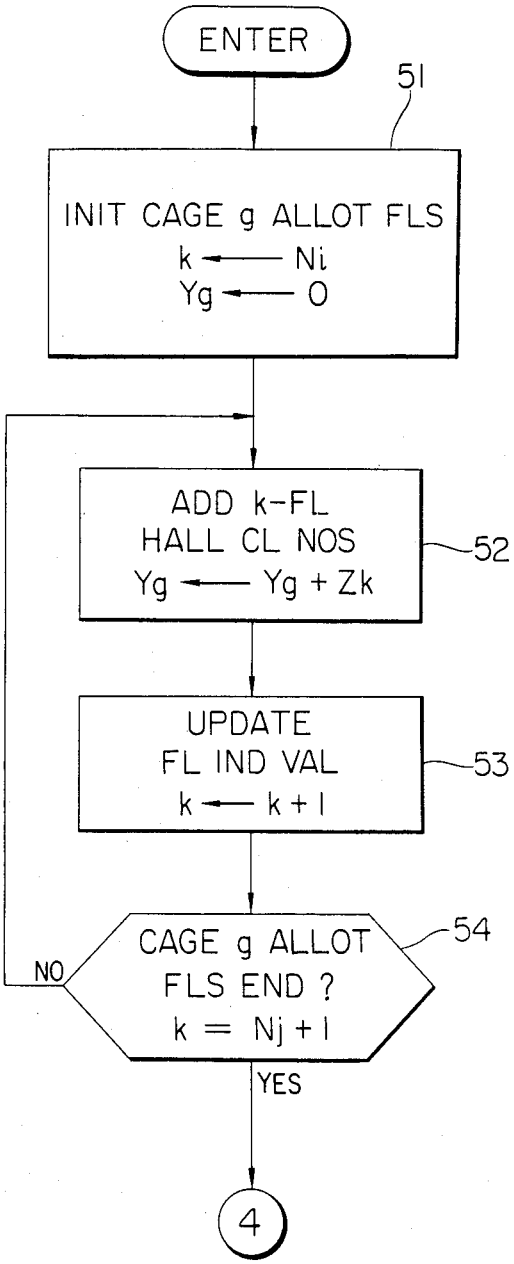
FIGS. 8 to 10 are flow charts of operations based on a dispersed waiting floor-determining program.
Figure 9:
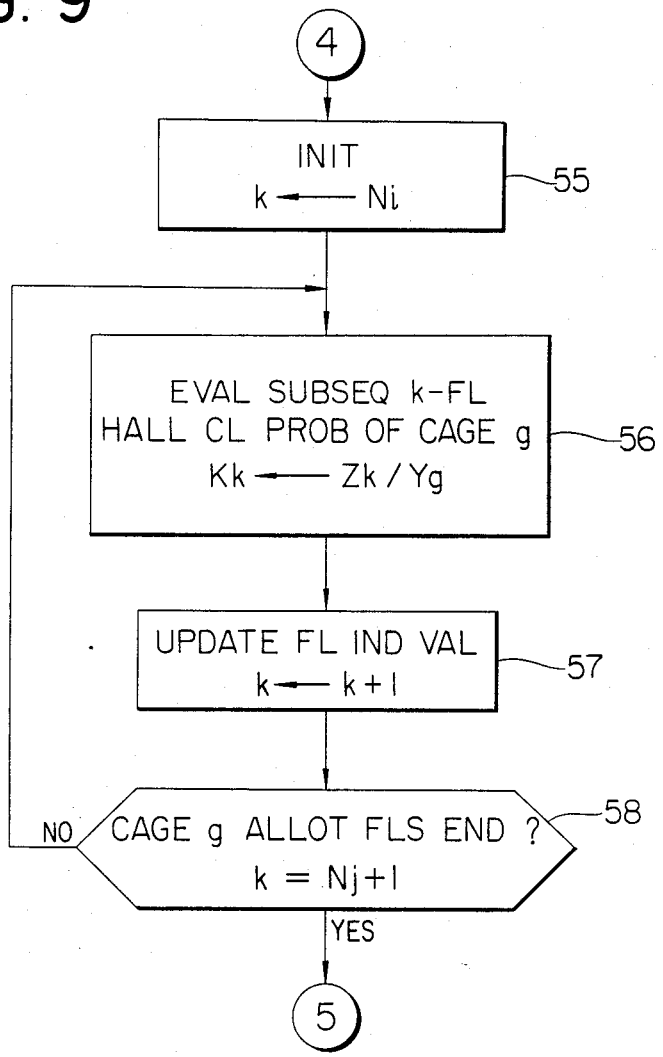
Figure 10:
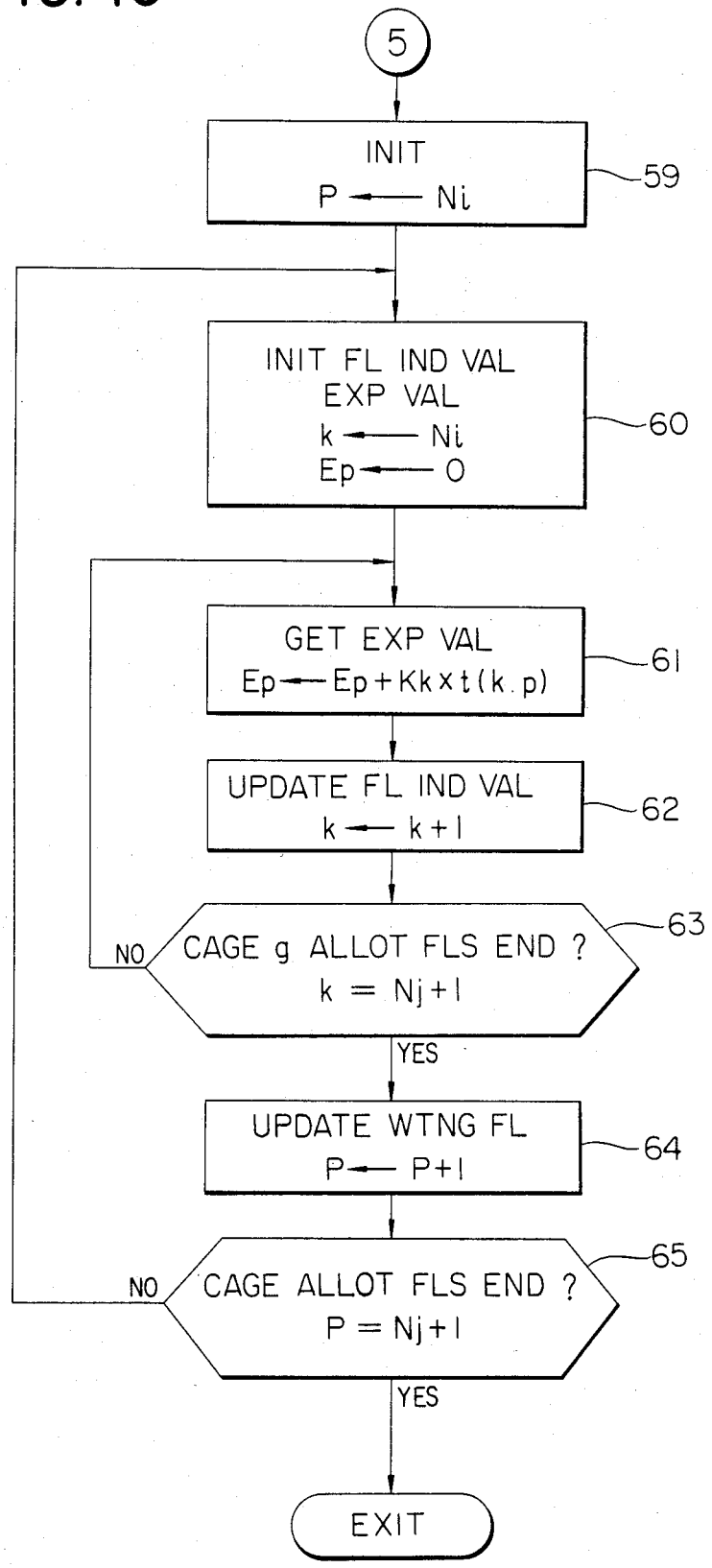

FIGS. 8 to 10 show steps constituting a part of the Step 26 and for determining which of the allotment floors cage No. g may be caused to wait at. At Step 51, the floor numeral k is set at $N_i$ (the allotment floors of cage g are assumed to be the $N_i$-th and $N_j$-th floors), and $Y_g$ is set at zero. At Step 52, $Y_g+Z_k$ is calculated to find the summation of the numbers of occurrence of hall calls at the allotment floors. At Step 53, the floor numeral k is updated. When it becomes $k=N_{j+1}$ at Step 54, the floor numeral k is set at the $N_i$-th floor at Step 55. At Step 56, the rate of occurrence $K_k$ of the hall calls of the k-th floor is obtained as $Z_k/Y_g$. The floor numeral k is updated at Step 57. These are repeated until $k=N_{j+1}$ holds at Step 58. Subject to $k=N_{j+1}$, the control flow proceeds to Step 59. At this Step 59, the floor P at which the cage is caused to wait is set at $N_i$. Step 60 initializes the floor numeral k to $N_i$ and $E_p$ to zero. Here, $E_p$ denotes the expected value of the period of time required until the next occurring hall call is responded to, when the cage is caused to wait at the P-th floor. At Step 61, $K_k$ x t(k, P) is obtained according to Equation (5) mentioned before and is added to $E_p$. t(k,P) has been calculated beforehand as the period of time required until the cage lying at the P-th floor reaches the k-th floor, and it has been stored in the ROM of the storage unit 9B. The floor numeral k is updated at Step 62, and Steps 61 and 62 are repeated until $k=N_{j+1}$ is held at Step 63. Subject to $k=N_{j+1}$, the waiting floor P is updated at Step 64. Steps 60–64 are repeated until $P=N_{j+1}$ is held at Step 65. When $P=N_{j+1}$ has been held, the series of operations end.

Figure 11:
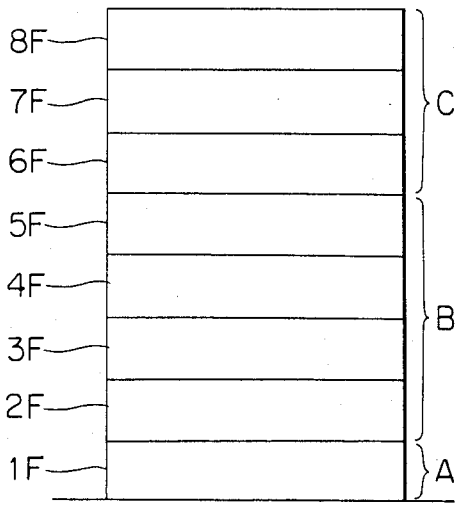
FIG. 11 is a diagram for explaining a concrete example of the dispersed waiting floor-determining operations.

Referring to FIG. 11, a concrete example of the above calculation will be described below.

It is now assumed that the three cages of cages No. 1–No. 3 be caused to dispersedly wait at the eight floors of the first floor (1F)-eighth floor (8F), and that the numbers of occurrence of the hall calls of the respective floors be as follows:

| | |
|---|---|
| 1F | 20 calls |
| 2F | 3 calls |
| 3F | 4 calls |
| 4F | 6 calls |
| 5F | 7 calls |
| 6F | 7 calls |
| 7F | 3 calls |
| 8F | 11 calls |

The summation Y of the numbers of occurrence of the hall calls is:

$$Y=(20+3+4+6+7+7+3+11)=61$$

Accordingly, the number of occurrence X of the hall calls per cage becomes:

$$X=61\div 3\approx 20$$

Therefore, the following is obtained:

| | |
|---|---|
| Allotment floor A of Cage No. 1 | 1F |
| Allotment floors B of Cage No. 2 | 2F–5F |
| Allotment floors C of Cage No. 3 | 6F–8F |

Next, the dispersed waiting floor of cage No. 1 is obviously the first floor. Let's calculate the expected values in the cases of causing cage No. 2 to wait at the respective floors. It is set that the running period of time between the adjacent floors is 2 seconds, and that 2 seconds are required for deceleration and stoppage.

$$2F\ 0\times\frac{3}{20}+4\times\frac{4}{20}+6\times\frac{6}{20}+8\times\frac{7}{20}=5.4$$

$$3F\ 4\times\frac{3}{20}+0\times\frac{4}{20}+4\times\frac{6}{20}+6\times\frac{7}{20}=3.9$$

$$4F\ 6\times\frac{3}{20}+4\times\frac{4}{20}+0\times\frac{6}{20}+4\times\frac{7}{20}=3.1$$

$$5F\ 8\times\frac{3}{20}+6\times\frac{4}{20}+4\times\frac{6}{20}+4\times\frac{7}{20}=3.6$$

It is understood that, when the cage is caused to wait at the fourth floor (4F), the expected value of the service time is minimized. Likewise, cage No. 3 affords the minimum expected value when caused to wait at the eighth floor (8F).

As set forth above, according to this invention, the demand magnitudes of cages in each time zone are estimated from the measured values of a traffic volume, floors in floor regions where the estimated values of the demand magnitudes for the respective cages in the corresponding time zone become equal are determined as dispersed waiting floors, and the cages are caused to dispersedly wait at such floors. Therefore, next occurring hall calls can be served most efficiently, and all the halls can be equally served.

What is claimed is:

1. A supervisory apparatus for elevators wherein cages are respectively caused to disperse and wait at predetermined floors during an inactive elevator operation during which a demand for the cages has decreased, comprising:

(a) means to measure traffic volumes of the cages, (b) demand magnitude estimation means to estimate the demand magnitudes from the measured traffic volumes for respective floors in each of a predetermined number of time zones into which one day is divided; and (c) dispersed waiting floor determination means to allot a suitable number of floors to each of the cages and determine one floor in the allotment floor region as a waiting floor on the basis of the estimated demand magnitudes so that the respective cages to dispersedly wait during the inactive elevator operation may take charges of equal demand magnitudes.

2. A supervisory apparatus for elevators as defined in claim 1, wherein the traffic volume measurement means measures at least one of a number of occurrence of hall calls, a load of persons having gotten on the cage, a number of persons having gatten on the cage, and a number of passengers waiting at the halls so as to obtain data expressive of the traffic volume.

3. A supervisory apparatus for elevators as defined in claim 2, wherein when said traffic volume measurement means has performed the operation of measuring the traffic volume, it additionally stores the measured result into storage means corresponding to one of the time zones containing a time at which the operation has been performed.

4. A supervisory apparatus for elevators as defined in claim 2, wherein said traffic volume measurement means measures the numbers of occurrence of the hall calls of the respective floors, and said demand magnitude estimation means calculates the estimated values of the numbers of occurrence of the hall calls of the respective floors in said each time zone on the basis of the measured results of said traffic volume measurement means.

5. A supervisory apparatus for elevators as defined in claim 4, wherein said dispersed waiting floor determination means derives the estimated values of the hall calls of the respective floors in one of said plurality of time zones from said estimation means, adds the estimated values for all the floors to obtain an estimated total number of the hall calls in said time zone, and divides the estimated total number by a number of the cages for the dispersed waiting, thereby to calculate a number of allotted hall calls per cage.

6. A supervisory apparatus for elevators as defined in claim 5, wherein said dispersed waiting floor determination means cumulates the estimated hall call values of the perspective floors for a number of continuous floors beginning at a certain floor and sets the floors from said certain floor to a floor at which the cumulated value equalizes to the number of allotted halls, as the allotment floor region to be served by a certain cage, thereby to determine the allotment floor region for each cage.

7. A supervisory apparatus for elevators as defined in claim 6, wherein said dispersed waiting floor determination means obtains a summation of the estimated hall call values in the whole allotment floor region of said each cage, and finds a ratio of the estimated hall call value of each floor within the allotment floor region to the summation (a rate of occurrence of the hall calls).

8. A supervisory apparatus for elevators as defined in claim 6, wherein said dispersed waiting floor determination means cumulates the estimated hall call values of the respective floors successively from a first floor, so that when the cumulated value has become equal to the number of allotted halls or a value smaller than, but approximate to, this number, the floors till then are set as the allotment floor region to be served by the cage; and it further cumulates the estimated hall call values of the respective floors successively from a next floor, so that when the cumulated value has become equal to a value double the number of allotted halls or a value small than, but approximate to, this double value, the floors till then are set as the allotment floor region to be served by a next cage; the allotment floor regions of the respective other cages being similarly determined.

9. A supervisory apparatus for elevators as defined in claim 7, wherein said dispersed waiting floor determination means finds, assuming one floor within the allotment floor region to be a cage waiting floor, expected values of service periods of time for the respective other floors within said floor region, and calculates a summation of the expected values so as to determine as the waiting floor a floor at which such summation of the expected values ia minimized.

10. A supervisory apparatus for elevators as defined in claim 9, wherein the expected value of the service period of time is calculated on the basis of a running period of time between the adjacent floors and a period of time required for deceleration and stoppage.

* * * * *